United States Patent [19]

Gabrielsson

[11] Patent Number: 4,490,867

[45] Date of Patent: Jan. 1, 1985

[54] BED ROCKING MECHANISM

[75] Inventor: Lars Gabrielsson, Göteborg, Sweden

[73] Assignee: Lycksele NYA Platprodukter AB, Lycksele, Sweden

[21] Appl. No.: 456,088

[22] Filed: Dec. 21, 1982

[51] Int. Cl.[3] ..... A47C 21/00

[52] U.S. Cl. ..... 5/509; 5/61; 5/109

[58] Field of Search ..... 5/61, 62, 108, 109, 5/508, 509; 128/33

[56] References Cited

U.S. PATENT DOCUMENTS

| | | | |
|---|---|---|---|
| 4,071,916 | 2/1978 | Nelson | 5/62 |
| 4,114,209 | 9/1978 | Sandlin | 5/62 |
| 4,152,795 | 5/1979 | Rodosta et al. | 5/62 |
| 4,256,095 | 3/1981 | Graham | 5/109 |
| 4,277,857 | 7/1981 | Svehang | 128/33 |

*Primary Examiner*—Gary L. Smith
*Assistant Examiner*—Michael F. Trettel
*Attorney, Agent, or Firm*—Dowell & Dowell

[57] ABSTRACT

A bed rocking mechanism intended to serve as support for a bed and to impart to the same a rocking or tilting movement in lateral direction, e.g. for turning of patients in long-term care. The rocking mechanism has a frame comprising casters or legs resting on the floor or the like and two vertical central pillars positioned adjacent to the longitudinally opposite ends of the rocking mechanism. The central pillars constitute bearings for a rocking part proper with beams extending laterally on both sides, the ends of said beams being interconnected by means of rails for the casters or legs of the bed.

6 Claims, 6 Drawing Figures

BED ROCKING MECHANISM

The present invention relates to a bed rocking mechanism devised to carry a bed and to impart to the same a rocking or tilting movement in a lateral direction, e.g. for turning of a patient confined to bed in long-term care.

In order to prevent creation of bedsores on patients confined to bed and who for various reasons are not capable to move to turn themselves, such patients must be turned at fixed times the whole day and night. This regular turning of patients requires, when to be performed in hospital, a lot of personnel, and when to be done in connection with nursing at home, the work involves also high stress, since in most cases a single person only is available for the work. The turning work must be made in the night-time also, which is especially burdensome. Therefore, an aim has been to mechanize this turning work, if possible, which has resulted in the production of bed rocking devices on which the bed can be placed and which impart to the bed a lateral rocking or tilting movement so that the patient is turned over from his one side to the other.

The main object of the present invention is to provide a bed rocking mechanism which can be used in combination with practically all existing types of hospital beds and usual beds with casters or legs.

Another object is to provide a bed rocking mechanism which renders possible to push a bed onto the rocking mechanism directly from the floor.

Other objects are to provide a bed rocking mechanism which is operated substantially noiselessly, with even, slow and adjustable movement and also adjustable angle of inclination, the bed rocking mechanism also being adapted to be returned quickly and easily to horizontal position. These and other objects are attained by the bed rocking mechanism according to the invention having been imparted the characterizing features defined in the subsequent claims.

Figure 1:
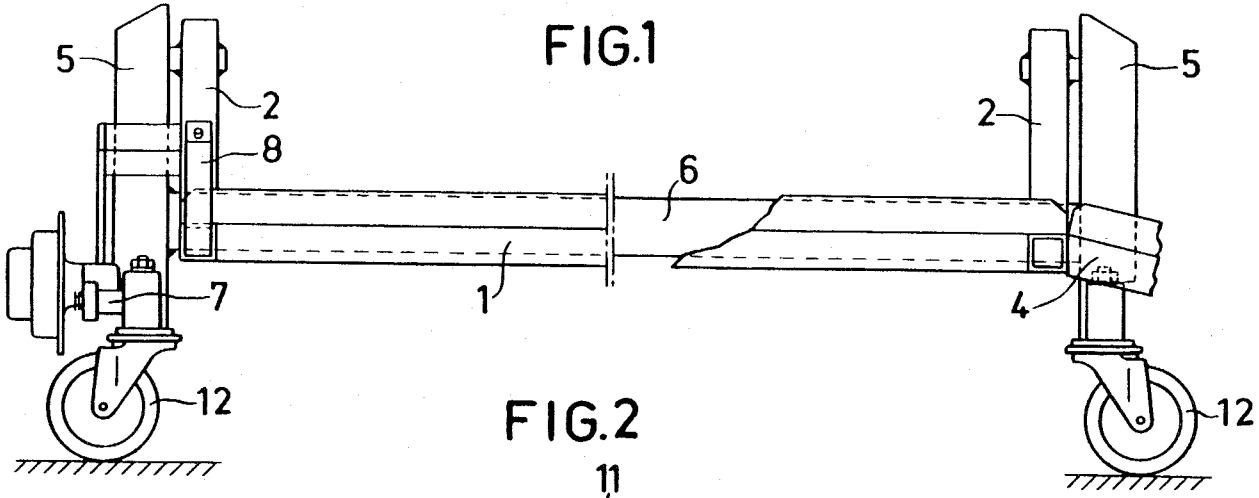
Figure 2:
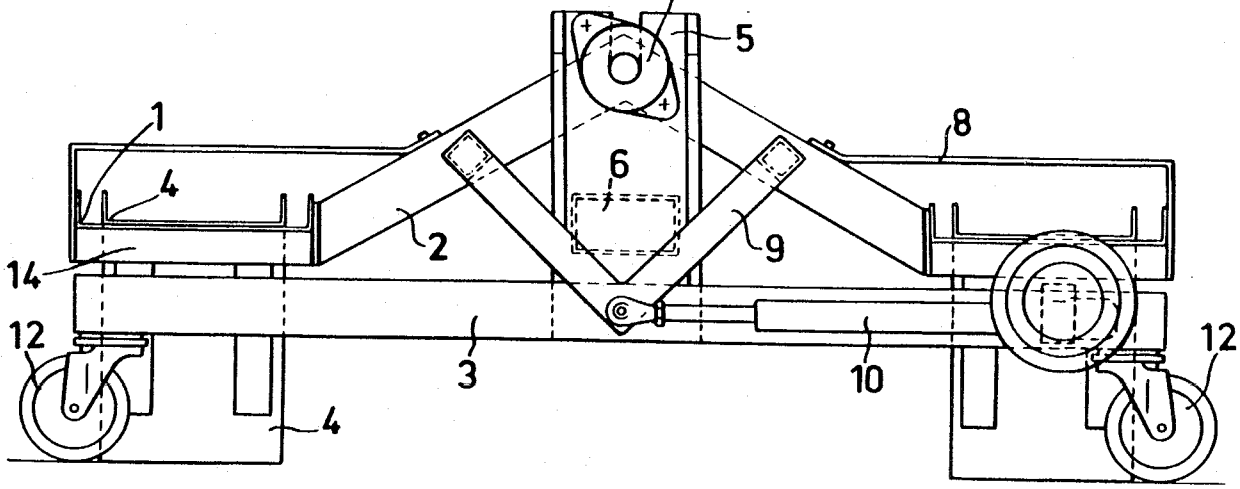
Figure 3:
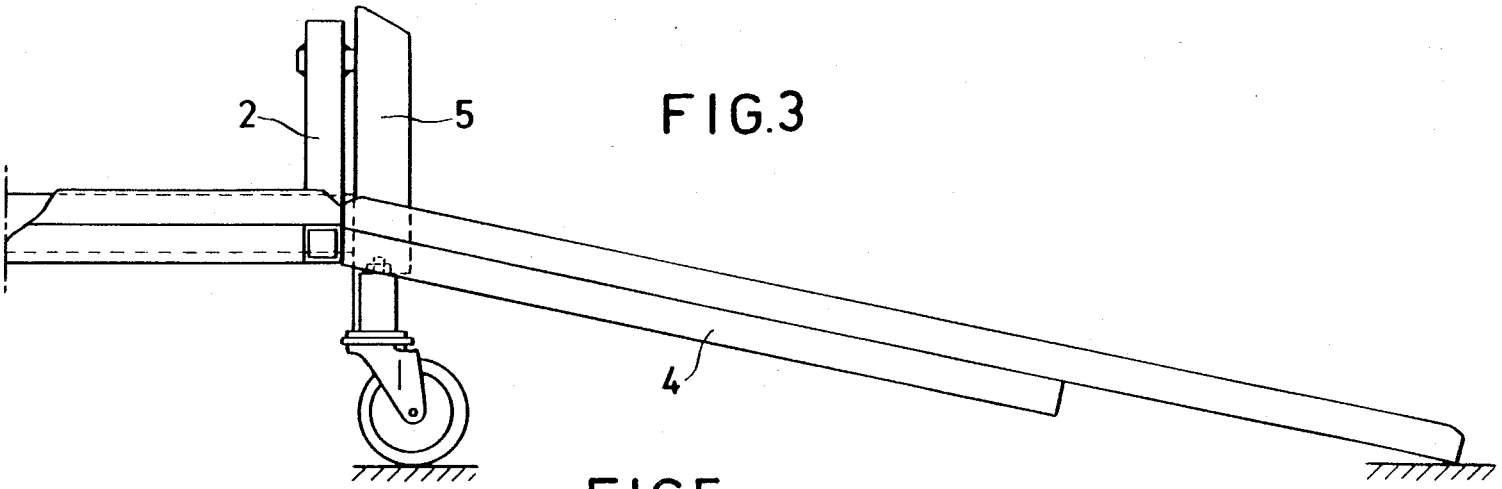
Figure 5:
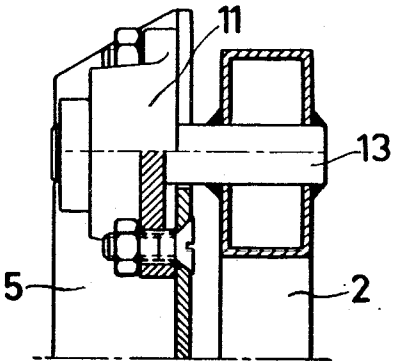
Figure 6:
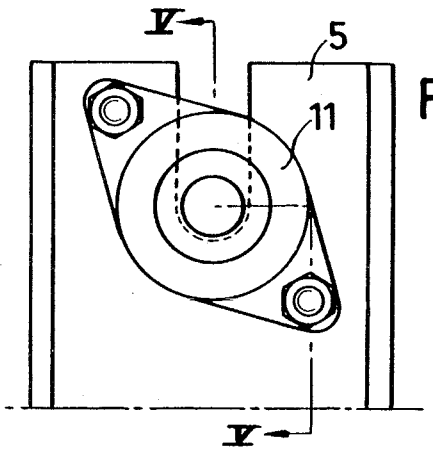
Figure 4:
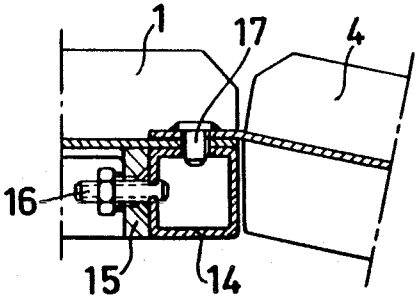

The invention will be described in more detail with reference to the attached drawings which illustrate a preferred embodiment of the bed rocking mechanism. FIG. 1 shows a side view of the bed rocking mechanism according to the invention. FIG. 2 shows an end view of the bed rocking mechanism seen from the left in FIG 1. FIG. 3 shows a side view of the right-hand end of the bed rocking mechanism of FIG. 1 with a push ramp attached thereto. FIG. 4 shows, partly in section, a detail of the coupling device for the push ramp. FIG. 5 shows, partly in section following line V—V in FIG. 6, the mounting on bearings of the rocking part proper of the mechanism in a central pillar. FIG. 6 shows a corresponding side-view.

The bed rocking mechanism shown in the FIGS. 1 and 2 comprises a frame consisting of a longitudinally extending, straight frame beam 6, which on each of its ends carries firstly a cross beam 3 and secondly a vertical central beam 5. Near to the outer ends of each cross beam 3, there are disposed casters 12 which support the frame on the ground, such as a floor. Disposed in each central beam 5 is a collar bearing 11 (FIGS. 5, 6), in which an axle journal 13 is mounted, which latter is secured by welding to, and supports, a carrier beam 2 for the rocking part of the mechanism, said beam 2 having the form of an inversed V. Each carrier beam 2 is at its both ends provided with beams 14 which in the neutral position of the rocking mechanism take a horizontal position. Between the beams 14 positioned on the same side of the rocking mechanism, rails 1 are provided, said rails being intended for the casters or legs of the bed to be placed upon. As especially is shown in FIG. 4, the rail 1 is secured onto the beam 14 by means of mounting plates 15 secured by welding onto the rail 1, said plates having apertures for fixing bolts 16 provided in the beam 14. As the apertures in the mounting plates 15 have been made oblong in horizontal direction, the rail 1 can be displaced in lateral direction in relation to the supporting beam 14 whereby the bed rocking mechanism can be adapted to varying breadths of, and distances between, the casters or legs of the bed and in this way becomes universally usable for all types of bedsteads.

For operation of the rocking or tilting movement a preferably electrically driven timer unit 10 is mounted by means of a fastening device 7 near the left end of the bed rocking mechanism shown in FIG. 2, said member with its reciprocating arm affecting a transmission arm 9 which is V-shaped and fixed to the co-operating carrier beam 2 of the bed rocking mechanism. The timer unit is fed with pulsating current and is controlled by means of a potentiometer in such a manner that the rocking part of the mechanism is imparted a suitable rocking or tilting movement. The timer unit is preferably adjustable so as to cause the bed to be stopped in the laterally inclined position in such a manner that the period of rest in each laterally inclined position will be longer than the period of rest in the shown neutral position, since the supine position of the patient is passed twice in comparison with each side position. The periods of rest in the side position must, therefore, be the double when compared with the period of rest in the supine position, e.g. the shown neutral position of the rocking mechanism. The adjustment shall also permit rapid setting of the timer unit for return of the bed rocking mechanism into the shown neutral position, e.g. for recurrent nursing measures or for removal of the bed from the rocking mechanism.

For pushing up and wheeling down a caster-equipped bed on or from, respectively, the bed rocking mechanism, the center pillars 5 are suitably designed with lowest possible height which permits most bed underframes to pass undisturbed over the central pillar. The pushing-up movement is rendered easier also by a lifting ramp 4, which by means of a dowel 17 can be hooked into apertures in the beams 14, whereby the ramp 4 is connected to the rail 1 of the bed rocking mechanism, as is shown in FIGS. 2 to 4. At the opposite end of the bed rocking mechanism the rocking part proper has a stop 8 to prevent the bed from sliding down at this end. The fixing of the pushed-up bed to the bed rocking mechanism can be carried out by means of, for example, clamping means provided in the rocking part, preferably textile belts or the like, which by means of tension members can be adapted to various bed constructions.

It will become clear from the drawing figures and the description that the bed rocking mechanism has a simple and functional structure which permits pushing on and wheeling down of beds without any disturbance by parts of the mechanism. In this connection it may be mentioned that the free distance of the rocking mechanism from the floor should be determined so as in the shown neutral position of the mechanism to permit insertion of lifting means of the type patient hoist or the like, the free space over the floor preferably being of the order of magnitude of 16 to 16.5 cm. The ramp 4 when not in use, is suitably devised to be stored retracted in, or inserted into, the rocking part of the mechanism.

Obviously, the invention is not limited to the shown embodiment, but may be varied in many respects within the basic idea thereof.

For operation of the timer unit, a control panel is employed, said panel being intended to be hanged up on one end of the bedstead and being equipped with an electric flex which is fixed onto the bed by magnets, said panel and flex being storable in a transport box mounted on the rocking mechanism during transport and storage.

I claim:

1. An apparatus for supporting a bed having leg members in such a manner as to rock or tilt the bed about the longitudinal axis thereof so that patients being supported on the bed may be turned from side to side comprising a frame means having a longitudinally extending beam means having end portions which are joined to a pair of generally perpendicularly disposed cross beams, said longitudinally extending beam means being oriented in generally parallel relationship to the longitudinal axis of the bed, a pair of spaced upstanding post means mounted to said frame means, each of said post means being oriented generally centrally along the length of said cross beams, bearing means carried by each of said post means, a rocker means pivotally supported by each of said bearing means, each of said rocker means having a pair of outwardly and downwardly extending arms having outer end portions, bed support means supported adjacent said outer portions of each of said arm means, said bed support means being disposed in elevated position with respect to said frame means, ramp means selectively engaged with said support means to thereby permit the bed to be urged there along into supporting engagement with said bed support means, and frame support means for supporting said frame means in an elevated position with respect to a supporting surface.

2. The apparatus for supporting a bed of claim 1 in which said bed support means includes a pair of elongated rail members having generally U-shaped cross sections, said rail members being oriented in generally parallel relationship with said longitudinally extending beam means of said frame means.

3. The apparatus for supporting a bed of claim 2 in which each said rail means have first and second end portions, means adjacent said first end portion of said rail means for selectively securing said ramp means thereto, and means adjacent said second end of said support means of said rail means for obstructing the relative movement of the bed with respect to said rail means.

4. The apparatus for supporting a bed of claim 2 in which each of said post means is of a height which will permit the bed to pass there over as the bed is longitudinally moved along said rail means.

5. The apparatus for supporting a bed of claim 2 including drive means carried by said frame means for moving said rocker means, and movement transmission members connecting said drive means to each of said outwardly and downwardly extending arms of said rocker means.

6. The apparatus for supporting a bed of claim 5 in which said drive means includes a reciprocating arm means, the movement of said reciprocating arm means being adjustable to selectively time the movement of said rocker means to thereby permit the rocking movement of a bed supported by the apparatus to be varied.

* * * * *